US006874248B2

(12) United States Patent
Hong et al.

(10) Patent No.: US 6,874,248 B2
(45) Date of Patent: Apr. 5, 2005

(54) DRYING MACHINE

(75) Inventors: Kyung Seop Hong, Inchun-si (KR); Young Hwan Park, Kwangmyung-si (KR); Mu Yong Choi, Seoul (KR); Dae Yun Park, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 5 days.

(21) Appl. No.: 10/386,516

(22) Filed: Mar. 13, 2003

(65) Prior Publication Data

US 2004/0134092 A1 Jul. 15, 2004

(30) Foreign Application Priority Data

Jan. 15, 2003 (KR) ..... 10-2003-0002654

(51) Int. Cl.[7] ..... F26B 25/00

(52) U.S. Cl. ..... 34/239; 34/603; 248/638; 248/675; 248/677

(58) Field of Search ..... 34/121, 601, 603, 34/239; 248/638, 674, 675, 676, 677, 678

(56) References Cited

U.S. PATENT DOCUMENTS

| | | | | | |
|---|---|---|---|---|---|
| 3,754,843 | A | * | 8/1973 | Dernedde et al. | 417/363 |
| 3,891,345 | A | * | 6/1975 | Doolin | 415/232 |
| 4,097,012 | A | * | 6/1978 | McIntyre | 248/674 |
| 4,621,438 | A | * | 11/1986 | Lanciaux | 34/77 |
| 4,805,859 | A | * | 2/1989 | Hudson | 248/148 |
| 5,699,992 | A | * | 12/1997 | Hauser | 248/635 |
| 6,378,834 | B1 | * | 4/2002 | Baker | 248/674 |

* cited by examiner

*Primary Examiner*—Denise L. Esquivel
*Assistant Examiner*—Kathryn S. O'Malley
(74) *Attorney, Agent, or Firm*—Birch, Stewart, Kolasch & Birch, LLP

(57) ABSTRACT

Disclosed herein is a drying machine. The drying machine comprises supporting members mounted on a base, and motor fixing brackets each including an insert part, through which a motor is inserted, and first and second supporting legs extending downwardly from the opposite ends of the insert part, the first and second supporting legs being engaged with the supporting members, whereby any vibration of the motor is prevented and attachment/detachment of the motor is easy and convenient.

19 Claims, 14 Drawing Sheets

DRYING MACHINE

BACKGROUND OF THE INVENTION

1. Field of the Invention

The present invention relates to a drying machine for drying clothes, etc., and more particularly to a drying machine having improved motor fixing brackets for fixing a motor securely to a base in the drying machine.

2. Description of the Related Art

As well known to those skilled in the art, a drying machine for clothes generally supplies air heated by a heater into a drum, in which clothes to be dried are put, to dry the clothes. Such a drying machine may be used independently only for drying the clothes, or incorporated with a laundry machine for washing and drying the clothes at one time.

Drying machines are generally classified into an exhausting-type drying machine and a condensing-type drying machine. The exhausting-type drying machine discharges humid air used to dry clothes to the outside, while the condensing-type drying machine condenses moisture laden in humid air used to dry clothes by heat exchange with outside air to produce low humidity air, and supplies the low humidity air to the clothes to be dried.

FIG. 1 is an exploded perspective view of the conventional drying machine, and FIG. 2 is a sectional view showing the interior of the drying machine.

As shown in FIGS. 1 and 2, the conventional drying machine includes a base 2, and a casing 10 placed on the base 2. The casing 10 has a clothes inlet 10*a* formed in the front part of the casing 10, and a door 10*b* pivotably attached to the casing 10. The clothes inlet 10*a* also acts as a clothes outlet, through which dried clothes are withdrawn. In the casing 10 is rotatably placed a drum 20, in which clothes to be dried are put. The drying machine further includes a heater 24 attached to the base 2 for heating air, a guide duct 26 for guiding the air heated by the heater 24 into the drum 20, a fan 28 for generating the blowing force necessary to blow the air heated by the heater 24 into the drum and to discharge the air in the drum to the outside of the drying machine, a lint trap 30 with a filter 31 for purifying the air used to dry the clothes in the drum 20, a fan housing 32 communicating with the lint trap 30 and enclosing the fan 28, an exhaust duct 34 communicating with the fan housing 32 for guiding the air discharged by the fan 28 to the outside of the drying machine, and a motor 40 attached to the base 2 for rotating the drum 20 and the fan 28.

The casing 10 includes side panels 12 and 13, a front panel 14 attached to the front ends of the side panels 12 and 13, and a rear panel 16 attached to the rear ends of the side panels 12 and 13. The rear panel 16 has an air suction hole 16*a* formed therein, through which outdoor air is sucked into the drying machine, and a duct through hole 16*b* formed therein, through which the exhaust duct 34 is extended. The casing 10 further includes a top cover 18 attached to the top ends of the side panels 12 and 13, and a control panel 19 provided on the top cover 18.

In the rear of the front panel 14 is provided a front supporter 36 for rotatably supporting the front part of the drum 20. The front supporter 36 has a clothes inlet 36*a* formed at the center thereof, and an exhaust hole 36*b* communicating with an inlet hole 30*a* of the lint trap 30 formed at the lower part thereof. The clothes inlet 36 also acts as a clothes outlet, through which dried clothes are withdrawn.

In the front of the rear panel 16 is provided a rear supporter 38 for rotatably supporting the rear part of the drum 20. The rear supporter 38 has an inflow hole 38*a* communicating with the upper end of the guide duct 26 formed in the center thereof. Through the inflow hole 38*a*, the air heated by the heater 24 is introduced into the drum.

The drum 20 is provided at the inner circumference thereof with vanes 21 for lifting the clothes.

The motor 40 is provided at the front and rear ends thereof with shafts 41*a* and 41*b*, respectively. On the shaft 41*a*, which is provided at the front end of the motor 40, is mounted the fan 28. A belt 22 is provided around the shaft 41*b*, which is provided at the rear end of the motor 40, and the drum 20, and serves to transfer the drive force of the motor 40 to the drum 20.

The motor 40 is placed on a supporting member 4, which is attached to the base 2. To the supporting member 4 are fixedly attached motor fixing brackets 47 and 48 by means of bolts 42. The motor 40 is fixed tightly between the supporting member 4 and the motor fixing brackets 47 and 48.

The operation of the conventional drying machine constructed as described above will now be described.

Clothes to be dried are put into the drum 20, and the door 10*b* is closed to operate the drying machine. The drum 20 and the fan 28 are rotated by the motor 40, and the heater 24 heats air. At this time, the clothes to be dried in the drum 20 are lifted by the vanes 21 and then dropped from the vanes 21.

By rotation of the fan 28, outside air is introduced into the heater 24 via the air suction hole 16*a*, and heated by the heater 24. The air of high temperature and low humidity, which is produced by the heater 24, is supplied into the drum 20 via the guide duct 26 and the inflow hole 38*a* of the rear supporter 38.

The air of high temperature and low humidity supplied into the drum 20 comes into contact with the clothes dropped from the vanes 21 to dry the clothes. After that, the air passes through the filter 31, and is exhausted outside the drying machine via the lint trap 30, the fan housing 32, and the exhaust duct 34 in turn.

There occurs vibration from the motor 40 while the clothes are being dried in the drying machine. The vibration not only gives rise to harsh noise, but has a bad influence upon the performance of the drying machine as well. Consequently, it is required to make sure that the motor 40 is fixed tightly to prevent such vibration.

FIG. 3 is a perspective view, partially cut away, of the conventional drying machine, FIG. 4 is a cross sectional view taken along line A—A of FIG. 3, FIG. 5 is a front view of the conventional drying machine showing a motor and motor fixing brackets disposed in the drying machine, and FIG. 6 is an exploded perspective view of a motor and motor fixing brackets of the conventional drying machine.

As shown in FIGS. 3 to 6, the motor 40 is provided at the front and rear parts thereof with hubs 43 and 44 for supporting the motor 40, respectively. On the outer circumferences of the hubs 43 and 44 are fitted vibration isolating rings 45 and 46, respectively, for absorbing the vibration.

The supporting member 4 comprises a front supporting member 4*a* for supporting the front part of the motor 40, and a rear supporting member 4*b* for supporting the rear part of the motor 40. The front supporting member 4*a* is provided at the middle of the upper part thereof with a semicircular groove 5, in which the lower part of the vibration isolating ring 45 is placed. Similarly, the rear supporting member 4*b* is provided at the middle of the upper part thereof with a semicircular groove 5, in which the lower part of the vibration isolating ring 46 is placed. At the right and left sides of the grooves 5 are formed fixing holes 6, into which the bolts 42 are screwed.

The motor fixing brackets 47 and 48 are placed on the front and rear supporting members 4*a* and 4*b* in such a manner that the brackets 47 and 48 surround the upper parts of the vibration isolating rings 45 and 46.

The motor fixing brackets 47 and 48 each have a semicircular curved part 49*a*, in which the upper part of each of the vibration isolating rings 45 and 46 is placed, and a fixing part 49*c* extended outwardly from the semicircular curved part 49*a*, which is placed on each of the front and rear supporting members 4*a* and 4*b*. In the fixing part 49*c* are formed fixing holes 49*b*, into which the bolts 42 are screwed, at opposite sides of the semicircular curved part 49*a*. The motor fixing brackets 47 and 48 are placed on the front and rear supporting members 4*a* and 4*b*, and then the bolts 42 are screwed into the fixing holes 49*b*.

The aforesaid conventional drying machine, however, has drawbacks in that after the motor fixing brackets 47 and 48 are placed on the supporting member 4, the bolts 42 must be screwed into the fixing holes 49*b* and 6 in turn while the fixing holes 49*b* of the motor fixing brackets 47 and 48 are brought into line with the fixing holes 6 of the supporting member 4, with the result that the assembling position of the motor fixing brackets 47 and 48 and the supporting member 4 may be changed during fastening with the bolts 42, and that it is hard to assemble the motor fixing brackets quickly and easily.

Furthermore, the motor fixing brackets 47 and 48 and the supporting member 4 must be fixed by means of the bolts 42 while the motor fixing brackets 47 and 48 are placed on the supporting member 4, with the result that the motor fixing brackets 47 and 49 do shake, which leads to loosening of the bolts. Besides, the drum 20 is disposed at the vicinity of the bolts 42, as shown in FIGS. 3 and 5. Consequently, it is necessary to disassemble the drum 20 and the related parts before the bolts 42 are unscrewed when the motor 40 is to be repaired or replaced.

SUMMARY OF THE INVENTION

Therefore, the present invention has been made in view of the above problems, and it is an object of the present invention to provide a drying machine in which any vibration of a motor is prevented and attachment/detachment of the motor is easy and convenient.

In accordance with one aspect of the present invention, the above and other objects can be accomplished by the provision of a drying machine comprising: a base; a casing disposed on the base; a drum rotatably placed inside the casing; a heater for heating air; a fan for blowing the air heated by the heater into the drum and for blowing the air passing through the drum outside the machine; a motor for rotating the fan and the drum; supporting members mounted on the base; and motor fixing brackets each including an insert part, through which the motor is inserted, and first and second supporting legs extending downwardly from the opposite ends of the insert part, the first and second supporting legs being engaged with the supporting members.

In accordance with another aspect of the present invention, there is provided a drying machine comprising: a base; a casing disposed on the base; a drum rotatably placed inside the casing; a condenser for condensing moisture laden in the air having passed through the drum by heat exchange between the air having passed through the drum and outside air; a fan for blowing the air having passed through the condenser into the drum; a heater for heating the air having passed through the condenser; a motor for rotating the fan and the drum; supporting members mounted on the base; and motor fixing brackets each including an insert part, through which the motor is inserted, and first and second supporting legs extending downwardly from the opposite ends of the insert part, the first and second supporting legs being engaged with the supporting members.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
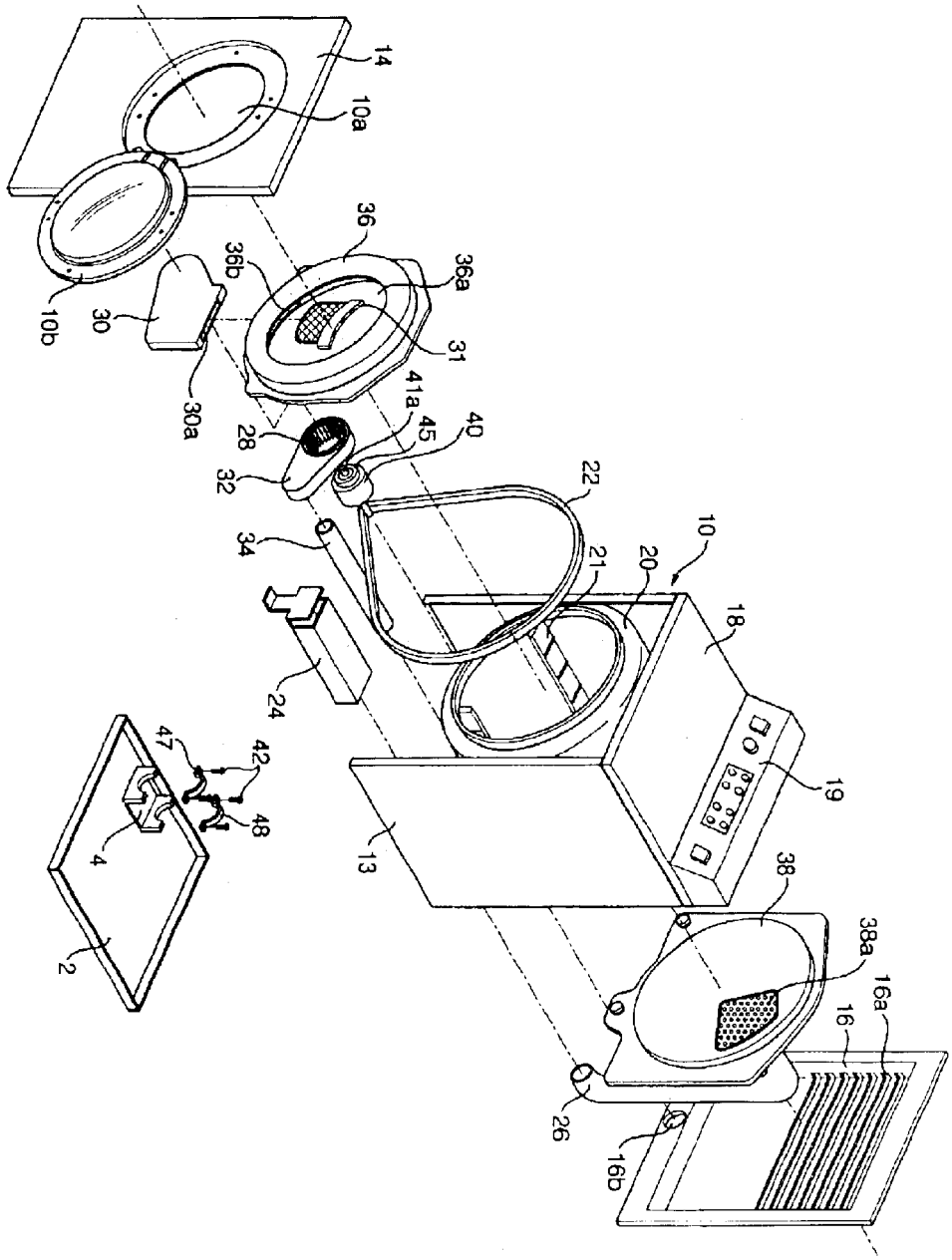
FIG. 1(Prior Art)
FIG. 1 is an exploded perspective view of the conventional drying machine.
Figure 2:
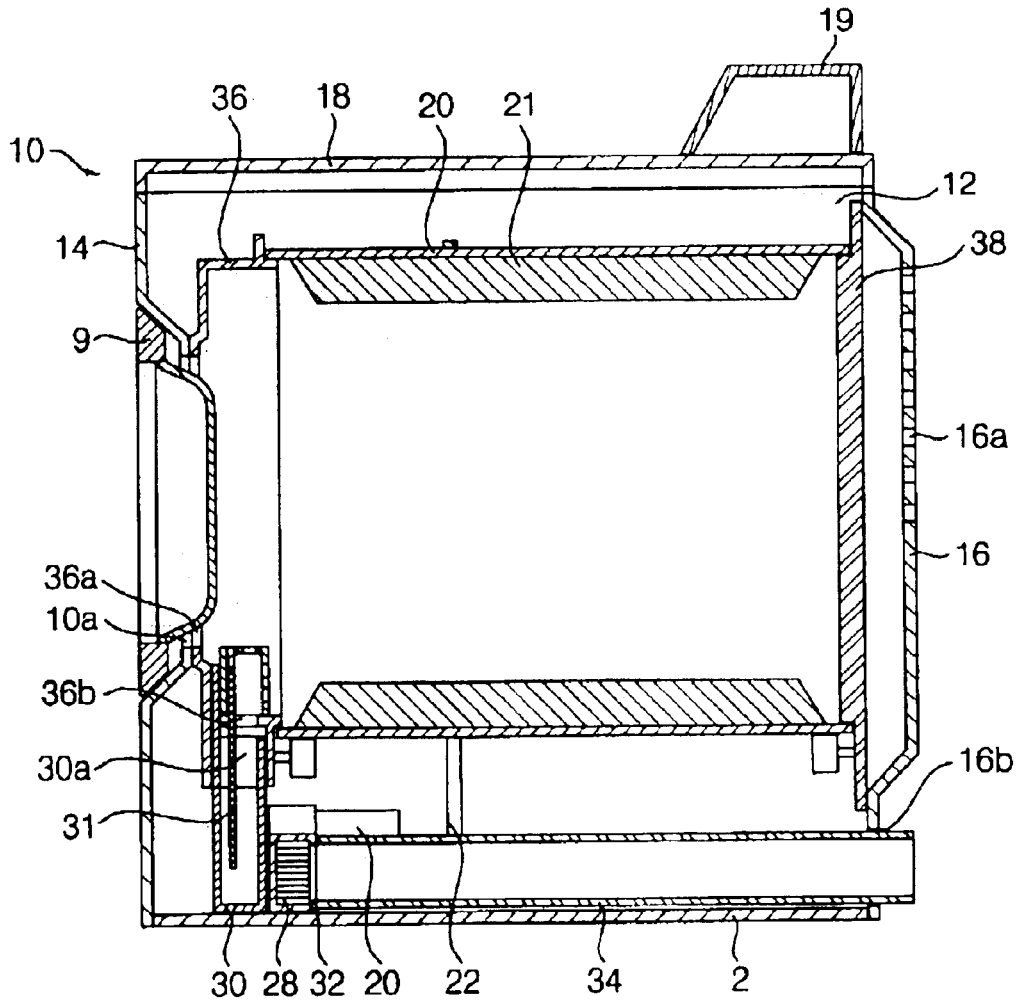
FIG. 2(Prior Art)
FIG. 2 is a sectional view showing the interior of the conventional drying machine.
Figure 3:
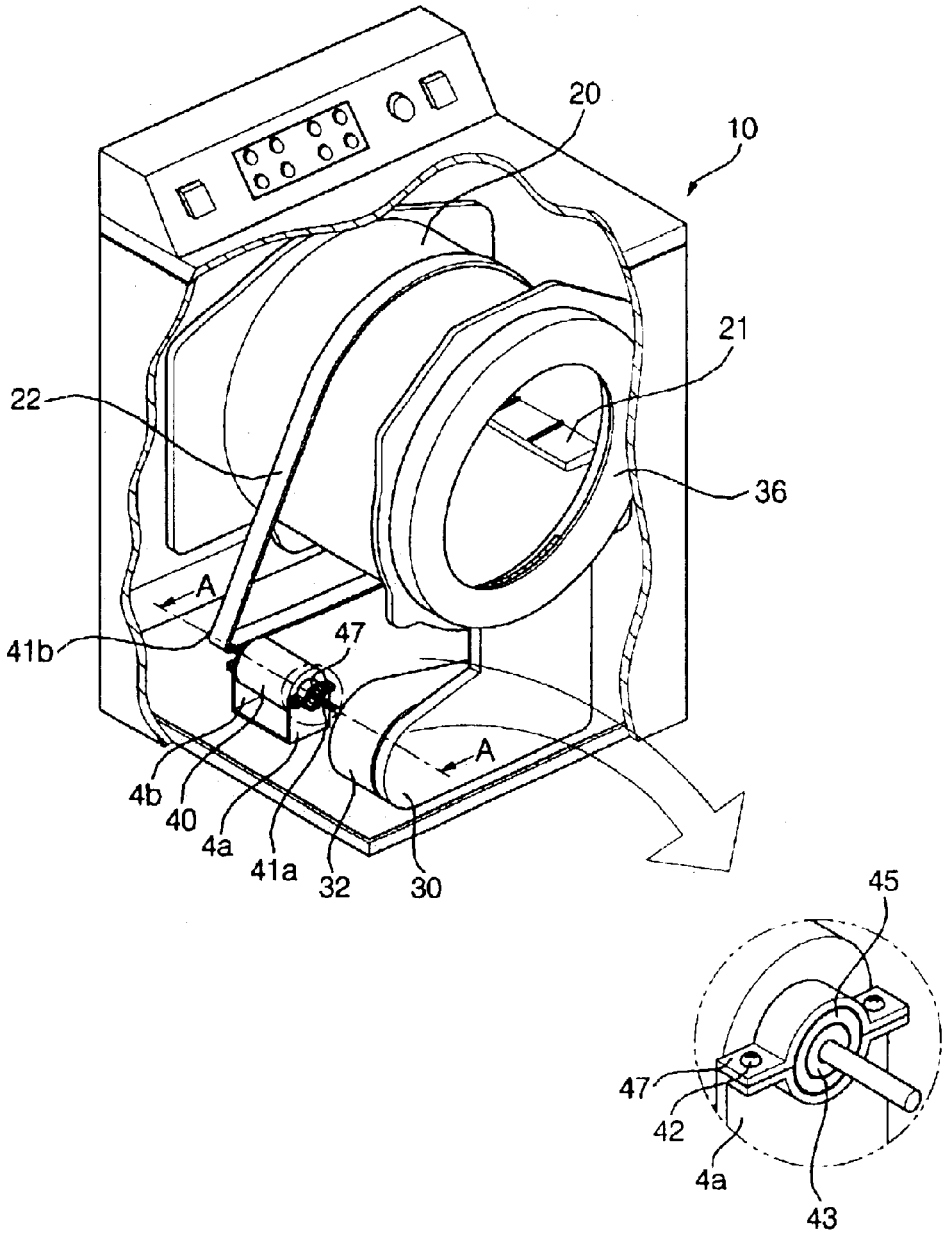
FIG. 3(Prior Art)
FIG. 3 is a perspective view, partially cut away, of the conventional drying machine.
Figure 4:
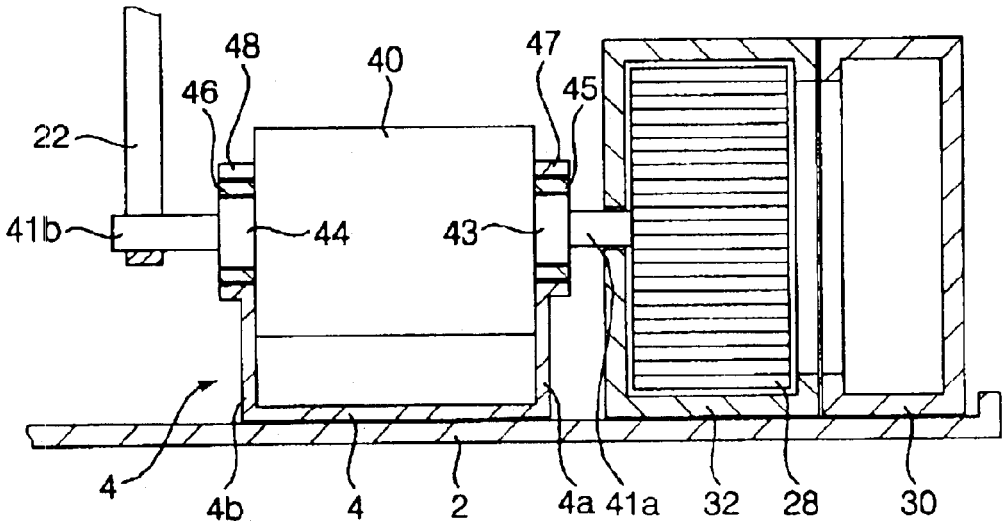
FIG. 4(Prior Art)
FIG. 4 is a cross sectional view taken along line A—A of FIG. 3.
Figure 5:
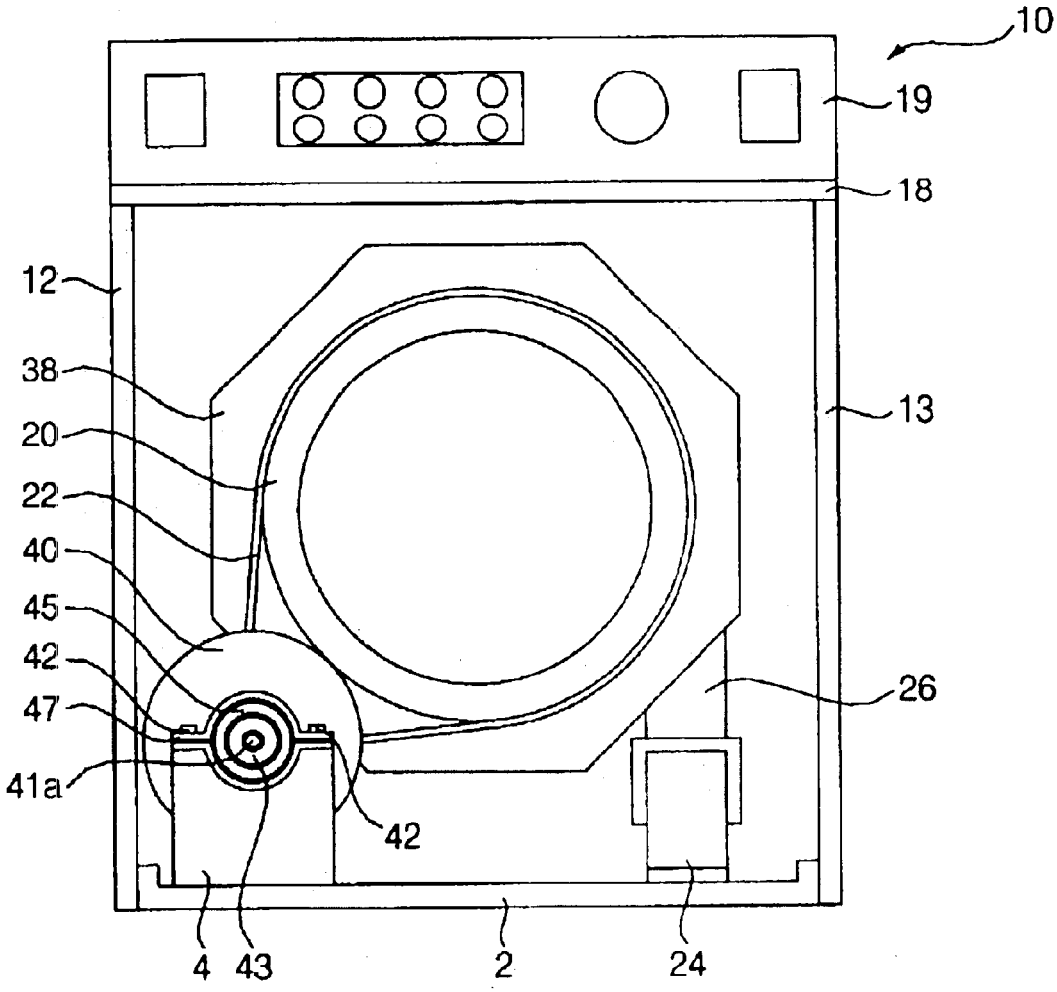
FIG. 5(Prior Art)
FIG. 5 is a front view of the conventional drying machine, showing a motor and motor fixing brackets disposed in the drying machine.
Figure 6:
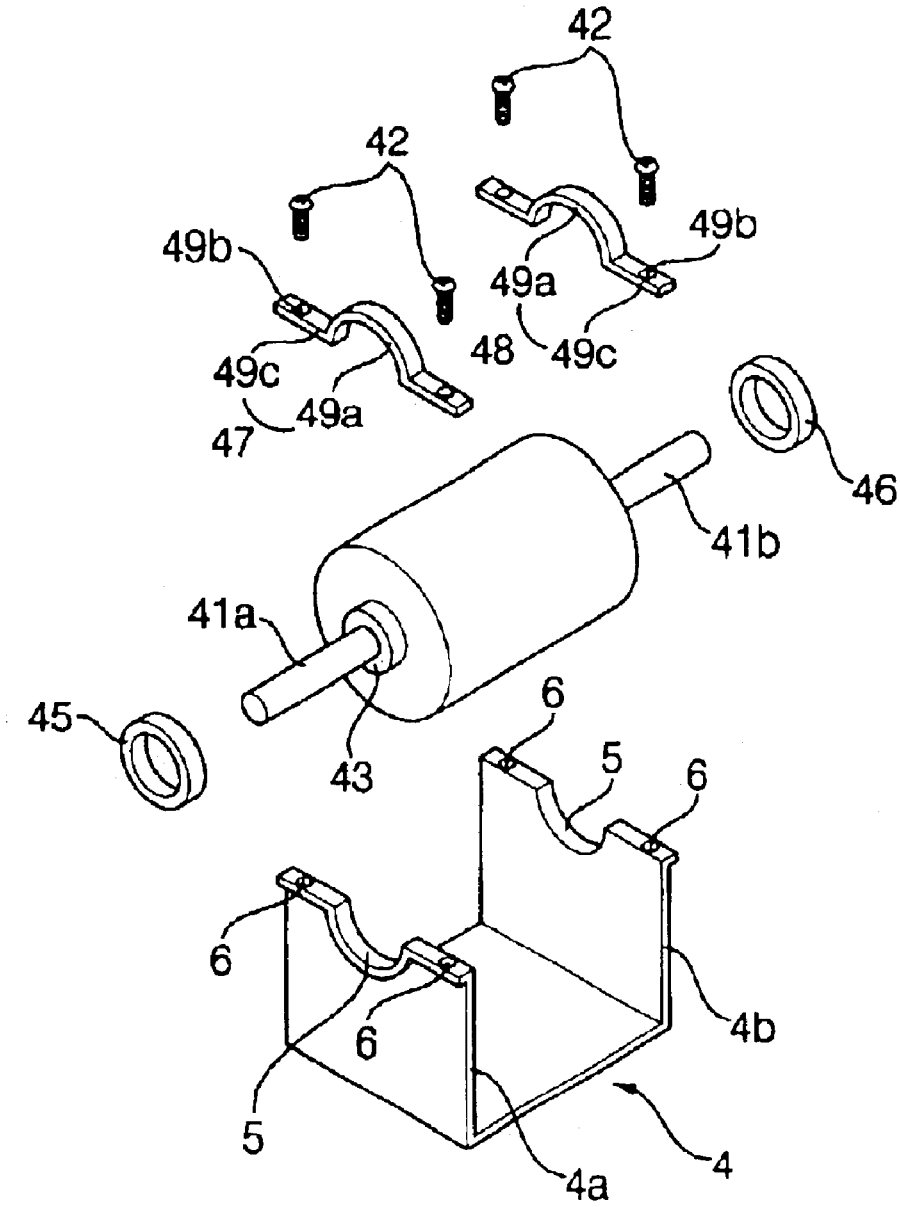
FIG. 6(Prior Art)
FIG. 6 is an exploded perspective view of a motor and motor fixing brackets of the conventional drying machine.
Figure 7:
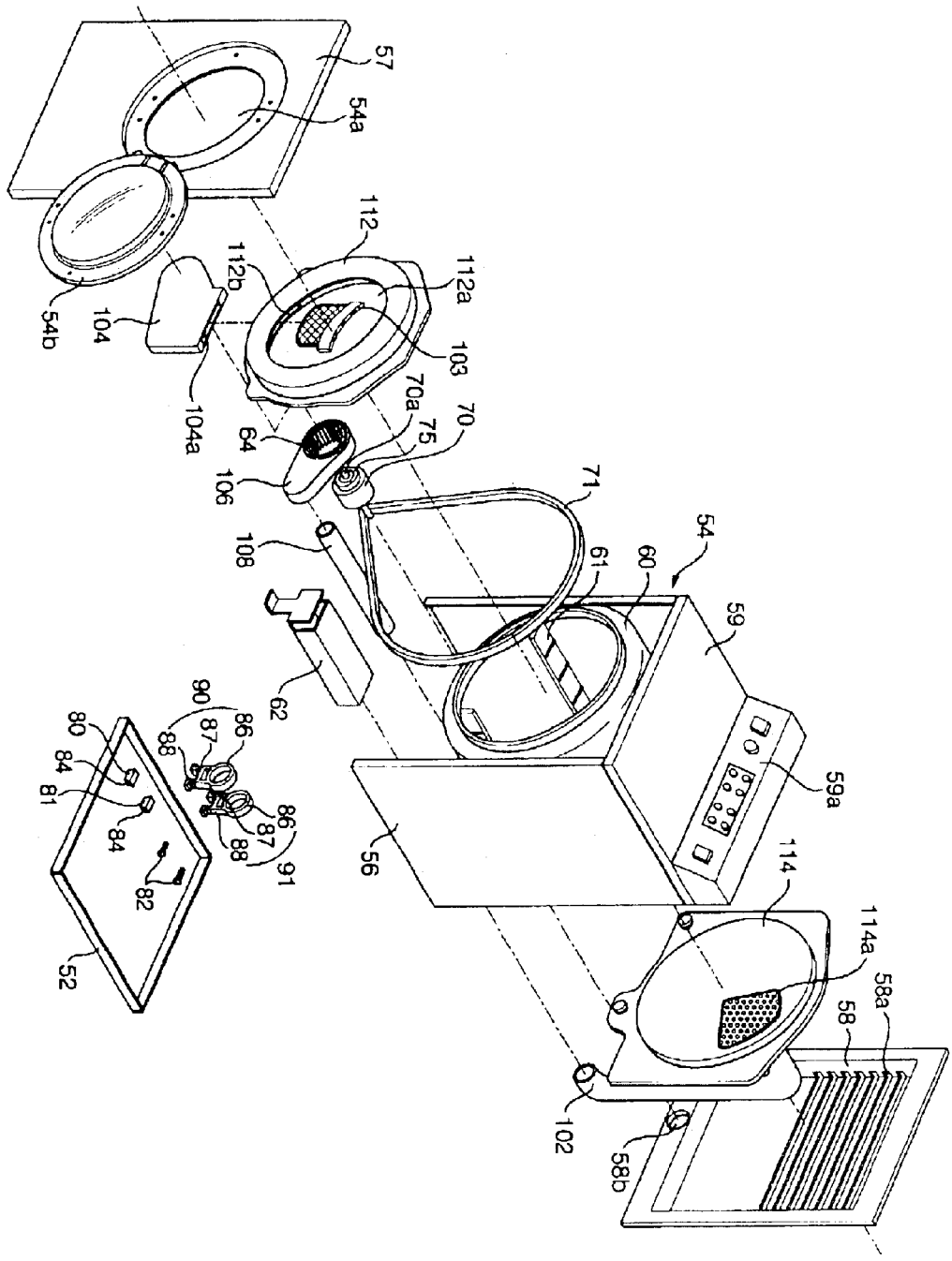
FIG. 7 is an exploded perspective view of a preferred embodiment of a drying machine according to the present invention.
Figure 8:
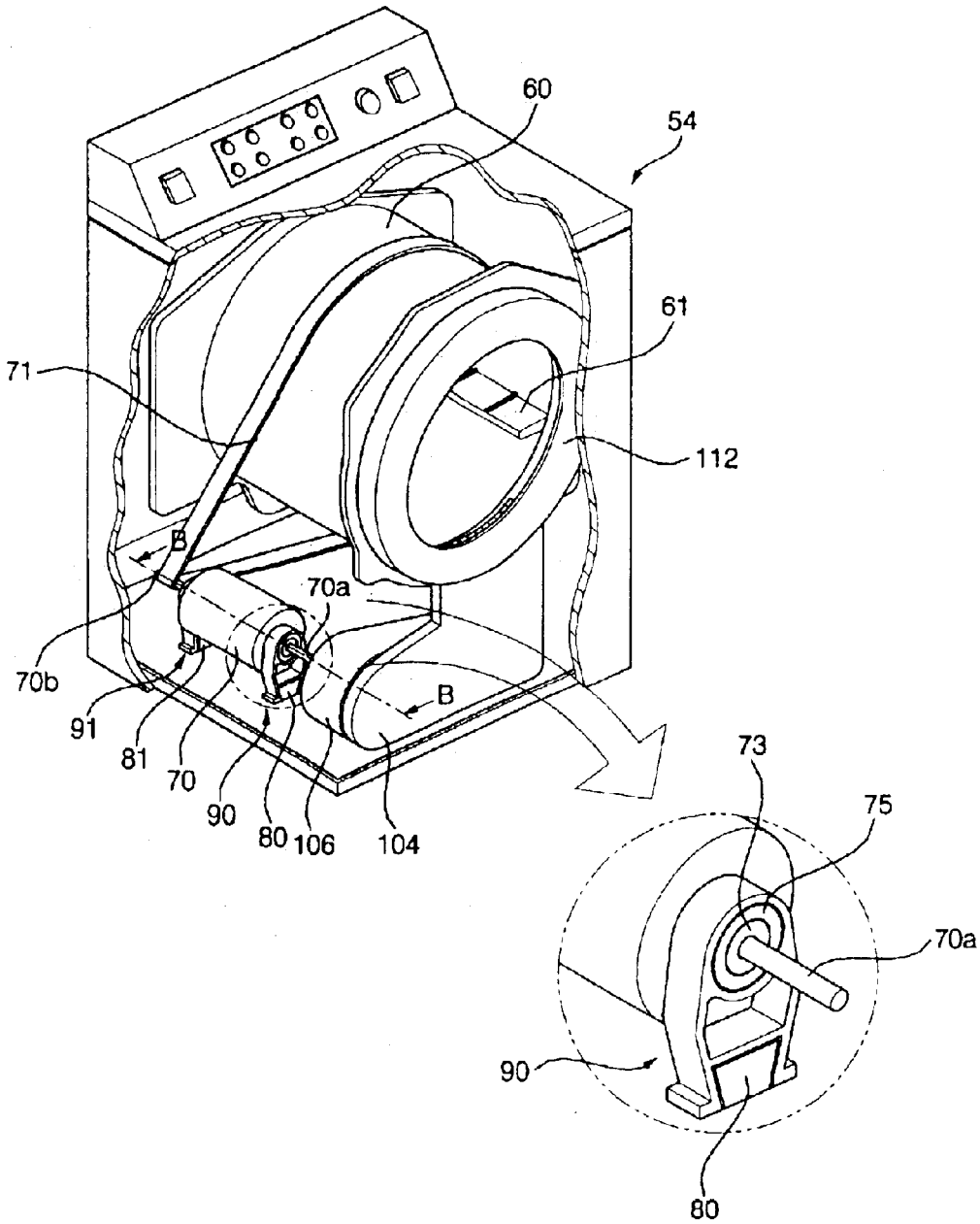
FIG. 8 is a perspective view, partially broken away, of the drying machine of the present invention.
Figure 9:
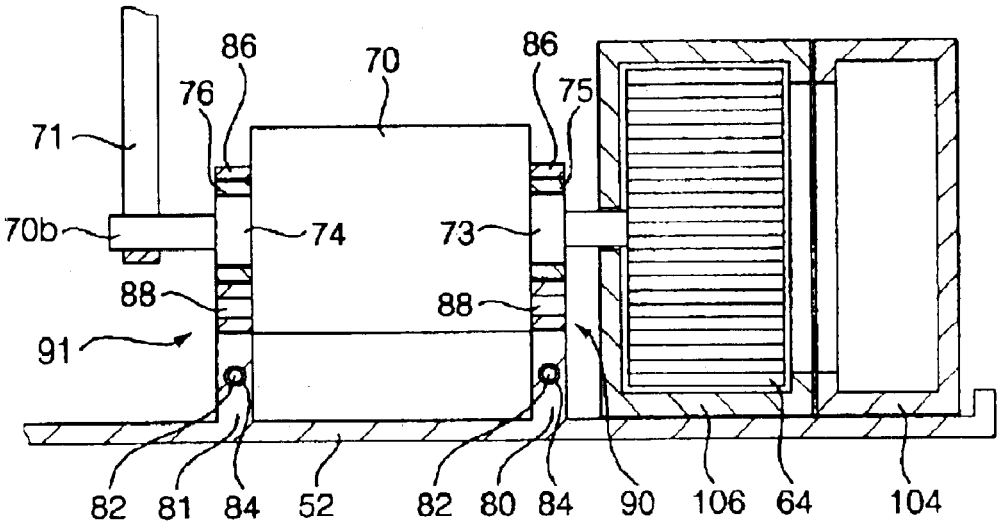
FIG. 9 is a cross sectional view taken along line B—B of FIG. 8.

FIG. 7 is an exploded perspective view of a preferred embodiment of a drying machine according to the present invention, FIG. 8 is a perspective view, partially broken away, of the drying machine of the present invention, and FIG. 9 is a cross sectional view taken along line B—B of FIG. 8.

As shown in FIGS. 7 to 9, the drying machine according to the present invention comprises a base 52, and a casing 54 placed on the base 52. The casing 52 has a clothes inlet 54*a*, which also acts as a clothes outlet, formed in the front central part of the casing 52, and a door 54*b* pivotably attached to the casing 54. In the casing 10 is rotatably placed a drum 60. In the drying machine are provided the following: a heater 62 attached to the base 52 for heating air, a fan 64 for generating the blowing force necessary to blow the air heated by the heater 62 into the drum 60 and to discharge the air in the drum 60 to the outside of the drying machine, a motor 70 attached to the base 52 for rotating the drum 60 and the fan 64, supporting members 80 and 81 placed on the base 52, and motor fixing brackets 90 and 91. The motor fixing brackets 90 and 91 each have an insert part 86, through which the motor 70 is inserted, and first and second supporting legs 87 and 88 extending downwardly from the opposite sides of the insert part 86, respectively. The supporting members 80 and 81 are fitted between the first and second supporting legs 90 and 91.

The drying machine further includes a guide duct 102 for guiding the air heated by the heater 62 into the drum 60, a lint trap 104 with a filter 103 for purifying the air used to dry the clothes in the drum 60, a fan housing 106 communicating with the lint trap 104 and enclosing the fan 64, and an exhaust duct 34 communicating with the fan housing 106 for guiding the air discharged by the fan 28 to the outside of the drying machine.

The casing 54 includes side panels 55 and 56, a front panel 57 attached to the front ends of the side panels 55 and 56, and a rear panel 58 attached to the rear ends of the side panels 55 and 56. The rear panel 58 has an air suction hole 58*a* formed therein, through which outdoor air is sucked into the drying machine, and a duct through hole 58*b* formed therein, through which the exhaust duct 34 is extended. The casing 54 further includes a top cover 59 attached to the top ends of the side panels 55 and 56, and a control panel 59*a* provided on the top cover 59.

In the rear of the front panel 57 is provided a front supporter 112 for rotatably supporting the front part of the drum 60.

The front supporter 112 has a clothes inlet 112*a* formed at the center thereof, through which clothes to be dried are thrown into the drum 60, and an exhaust hole 112*b* communicating with an inlet hole 104*a* of the lint trap 104 formed at the lower part thereof. The clothes inlet 112*a* also acts as a clothes outlet, through which dried clothes are withdrawn. The filter 103 is inserted into the lint trap 104 through the exhaust hole 112*b* of the front supporter 112 and the inlet hole 104 of the lint trap 104.

In the front of the rear panel 58 is provided a rear supporter 114 for rotatably supporting the rear part of the drum 60.

The rear supporter 114 has an inflow hole 114*a* communicating with the upper end of the guide duct 102 formed in the center thereof. Through the inflow hole 114*a*, the air heated by the heater 62 is introduced into the drum 60.

The drum 60 is provided at the inner circumference thereof with vanes 61 for lifting the clothes.

The heater 62 comprises a hollow heater case and a heating coil arranged in the hollow heater case. When current is applied to the heating coil, the heating coil generates heat, by which the inside of the heater case is heated as well as the heater case itself. As a result, the air having passed through the heater has high temperature and low humidity.

The motor 70 is provided at the front and rear ends thereof with front and rear shafts 70*a* and 70*b*, respectively. On the front shaft 70*a*, which is provided at the front end of the motor 70, is mounted the fan 64. A belt 71 is provided around the rear shaft 70*b*, which is provided at the rear end of the motor 70, and the drum 60. When the motor 70 is driven, the fan 64 and the drum 60 are thus rotated simultaneously.

The motor 70 is supported in such a manner that the front and rear ends of the motor 70 are symmetrical with each other. At the front part of the motor 70 is provided a front hub 73 in such a manner that the front hub 73 is fitted on the outer circumference of the front shaft 70*a*. Similarly, at the rear part of the motor 70 is provided a rear hub 74 in such a manner that the rear hub 74 is fitted on the outer circumference of the rear shaft 70*b*. On the outer circumferences of the front and rear hubs 73 and 74 are fitted vibration isolating rings 75 and 76 for absorbing the vibration from the motor 70, respectively.

The supporting members 80 and 81 are placed on the base 52 in such a manner that the supporting members 80 and 81 are arranged apart from each other by the distance between the front and rear hubs 73 and 74.

The front supporting member 80, one of the supporting members 80 and 81, is preferably formed integrally with the base 52. Similarly, the rear supporting member 81, the other of the supporting members 80 and 81, is preferably formed integrally with the base 52. Alternatively, the supporting members 80 and 81 may be formed separately from the base 52 and attached to the base 52 by means of bolts or adhesives.

The motor fixing brackets 90 and 91 comprise the front motor fixing bracket 90, which is engaged with the vibration isolating ring 75 on the front hub 73 and the front supporting member 80, and the rear motor fixing bracket 91, which is engaged with the vibration isolating ring 76 on the rear hub 74 and the rear supporting member 81. The motor 70 is fixed stably by means of the motor fixing brackets 90 and 91.

Figure 10:
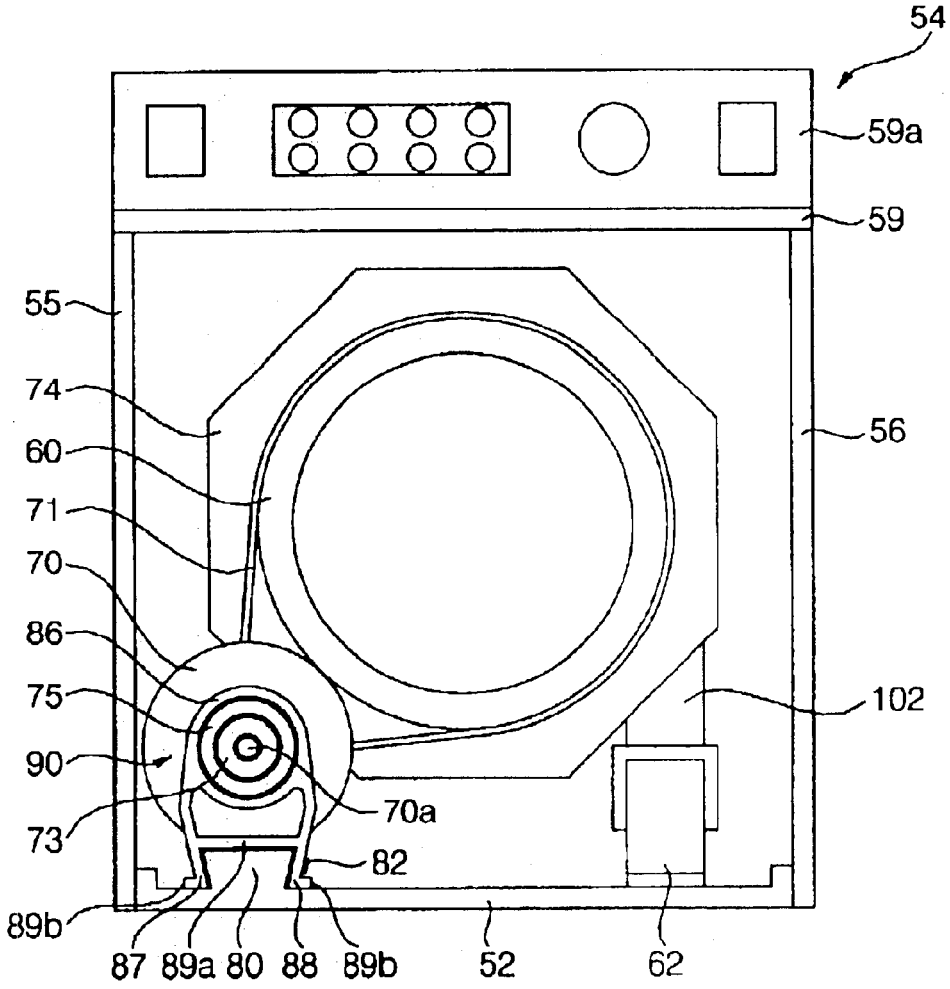
FIG. 10 is a front view of the drying machine according to the present invention, showing that a motor and motor fixing brackets are disposed in the drying machine.
Figure 11:
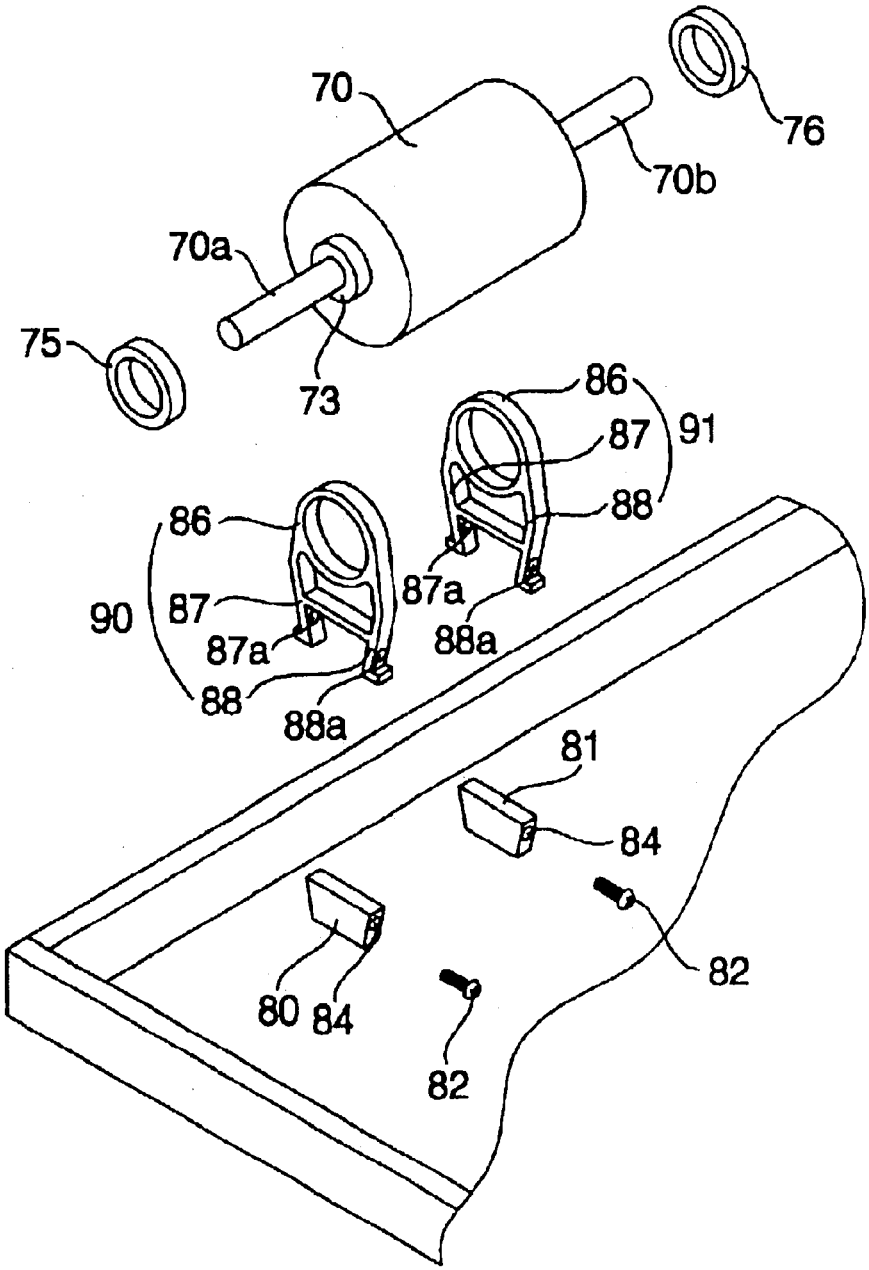
FIG. 11 is an exploded perspective view of the motor and the motor fixing brackets of the present invention.

FIG. 10 is a front view of the drying machine according to the present invention, showing that a motor and motor fixing brackets are disposed in the drying machine, and FIG. 11 is an exploded perspective view of the motor and the motor fixing brackets of the present invention.

Each of the supporting members 80 and 81 is formed in such a manner that the width between the opposite sides of each of the supporting members 80 and 81 is increased upwardly. The supporting members 80 and 81 each have a fixing hole 84 penetrating the supporting member 80 or 81 from one side of the supporting member 80 or 81 to the other side of the supporting member 80 or 81, into which a fixing screw 82 is inserted, so that the supporting members 80 and 81 and the motor fixing brackets 90 and 91 fitted on the supporting members 80 and 81 are fixed tightly to each other by means of the fixing screws 82, respectively.

The first and second supporting legs 87 and 88 of the motor fixing brackets 90 and 91 are formed in such a manner that the distance between the first and second supporting legs 87 and 88 is decreased downwardly. Consequently, the motor fixing brackets 90 and 91 are easily engaged with the supporting members 80 and 81, and the motor fixing brackets 90 and 91 are not disengaged easily from the supporting members 80 and 81.

The insert parts 86 of the motor fixing brackets 90 and 91 are formed in the form of rings so that the vibration isolating rings 75 and 76 are inserted into the insert part 86 of the motor fixing brackets 90 and 91 at the front and rear parts of the motor 70.

The motor fixing brackets 90 and 91 are configured in such a manner that the distance between the first and second supporting legs 87 and 88 at the lower ends of the supporting legs 87 and 88 is less than that between the first and second supporting legs 87 and 88 at the upper ends of the supporting legs 87 and 88. Furthermore, the motor fixing brackets 90 and 91 are formed of plastic with a prescribed elasticity. On this account, when the motor fixing brackets 90 and 91 are moved downwardly to be engaged with the supporting members 80 and 81, respectively, the distance between the first and second supporting legs 87 and 88 at the lower ends thereof becomes wider so that the motor fixing brackets 90 and 91 are easily engaged with the supporting members 80 and 81. After that, the first and second supporting legs 87 and 88 return to their original positions.

Between the first and second supporting legs 87 and 88 of the motor fixing brackets 90 and 91 is provided a horizontal reinforcing bar 89*a* for preventing any excessive widening of the first and second supporting legs 87 and 88 when the motor fixing brackets 90 and 91 are fitted on the supporting members 80 and 81 from the above, respectively, to avoid any breakage of the first and second supporting legs 87 and 88.

The first and second supporting legs 87 and 88 of each of the motor fixing brackets 90 and 91 are provided at the lower ends thereof with bent parts 89*b*, respectively, by which the motor fixing brackets 90 and 91 are placed stably over a wider area of the base 52, with the result that the motor fixing brackets 90 and 91 do not shake, and thus the motor fixing brackets 90 and 91 support strongly the motor 70.

At the first and second supporting legs 87 and 88 are formed fixing holes 87*a* and 88*a*, respectively, each of which communicates with the fixing hole 84 of the supporting members 80 and 81 when the motor fixing brackets 90 and 91 are engaged with the supporting members 80 and 81. The fixing screw 82 is inserted into the fixing holes 88*a*, 84 and 87*a* or disengaged from the fixing holes 88*a*, 84 and 87*a* at the side of at least one of the first and second supporting legs 87 and 88. Consequently, it is possible to attach the motor 70 and motor fixing brackets 90 and 91 to the base 2 or detach the motor 70 and motor fixing brackets 90 and 91 from the base 2 without disassembling the drum 60 when it is necessary to repair or replace the motor 70.

A thread part is formed on the inner circumference of the fixing hole 87*a* of the first and second supporting legs 87 and 99 of the motor fixing brackets 90 and 91, while a thread part is formed on the outer circumference of the fixing screw 82. The fixing screw 82 is inserted into the fixing hole 88*a* of the supporting leg 88, which has no thread formed therein, into the fixing hole 84 of the supporting members 80 and 81, which also has no thread formed therein, and into the fixing hole 87*a* with the thread part therein. The first and second supporting legs 87 and 88 approach each other by virtue of the engagement of the fixing screw 82 and the fixing hole 87*a*, so that the first and second supporting legs 87 and 88 come into secure contact with the inclined sides of the supporting members 80 and 81.

The operation of the drying machine with the above-stated construction according to the present invention will now be described.

Clothes to be dried are put into the drum 60, and the door 54*b* is closed to operate the drying machine. The drum 60 and the fan 64 are rotated by means of the motor 70, which is supported securely by the motor fixing brackets 90 and 91 and the supporting members 80 and 81. The heater 62 heats air.

The clothes to be dried in the drum 60 are lifted by the vanes 61 and then dropped from the vanes 61.

By rotation of the fan 64, outside air is introduced into the heater 62 via the air suction hole 58*a*, and heated by the heater 62. The air of high temperature and low humidity, which is produced by the heater 62, is supplied into the drum 60 via the guide duct 102 and the inflow hole 114*a* of the rear supporter 114.

The air of high temperature and low humidity supplied into the drum 60 comes into contact with the clothes dropped from the vanes 61 to dry the clothes. After that, the air passes through the filter 103, and is exhausted outside the drying machine via the lint trap 104, the fan housing 106, and the exhaust duct 108 in turn.

There occurs vibration from the motor 70, to which the fan 64 and the belt 71 are connected, while the clothes are being dried in the drying machine. However, such vibration is absorbed by means of the vibration isolating rings 75 and 76. The motor fixing brackets 90 and 91 are engaged securely with the supporting members 80 and 81 while the vibration isolating rings 75 and 76 are inserted into the insert parts 86 of the motor fixing brackets 90 and 91. Consequently, no vibration is transmitted to the base 52 or the casing 54.

Figure 12:
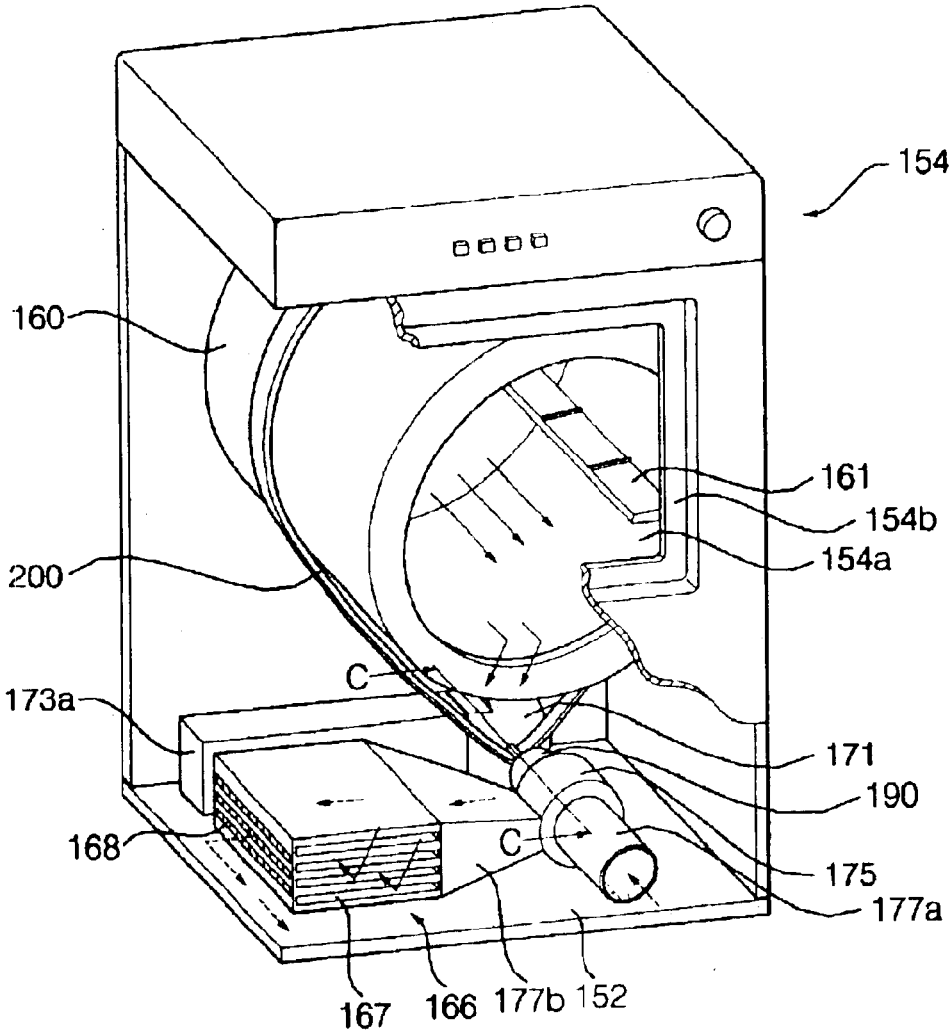
FIG. 12 is a perspective view, partially broken away, of an alternative embodiment of the drying machine according to the present invention.
Figure 13:
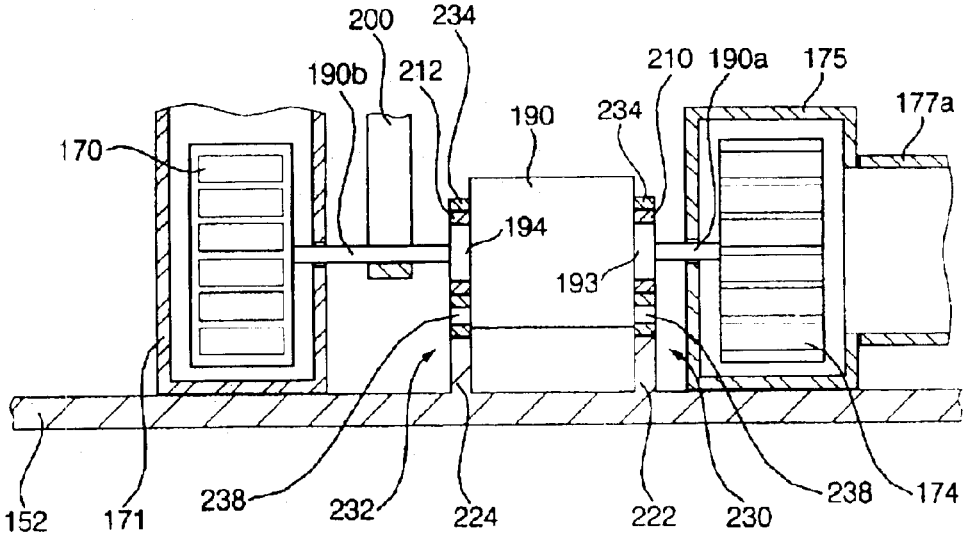
FIG. 13 is a cross sectional view taken along line C—C of FIG. 12.
Figure 14:
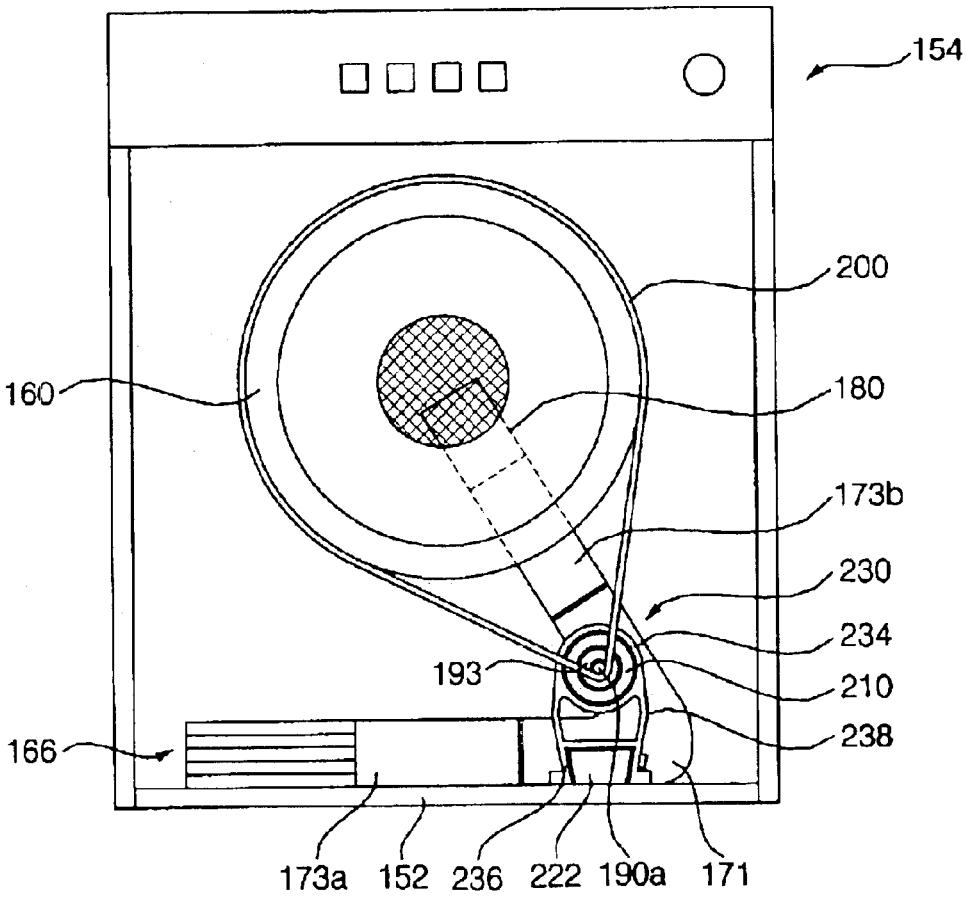
FIG. 14 is a front view of the drying machine according to the present invention, showing that a motor and motor fixing brackets are disposed in the drying machine.

FIG. 12 is a perspective view, partially broken away, of an alternative embodiment of the drying machine according to the present invention, FIG. 13 is a cross sectional view taken along line C—C of FIG. 12, and FIG. 14 is a front view of the drying machine according to the present invention showing that a motor and motor fixing brackets are disposed in the drying machine.

As shown in FIGS. 12 to 14, the drying machine according to the present invention comprises a base 152, and a casing 54 placed on the base 152. The casing 152 has a clothes inlet 154*a*, which also acts as a clothes outlet, formed in the front central part of the casing 152, and a door 154*b* pivotably attached to the casing 154. In the casing 10 is rotatably placed a drum 160.

The drying machine further includes a condenser 166 for condensing moisture laden in the air having passed through the drum 160 by heat exchange between the air having passed through the drum 160 and outside air, a first fan 170 with a circulation duct for blowing the air passing through the condenser 166 into the drum, a second fan 174 with a suction duct for blowing outside air to the condenser 166, a heater 180 for heating the air entering the drum 160 after passing through the condenser 66, a motor 190 for rotating the drum 160 and the first and second fans 170 and 174, supporting members 222 and 224 placed on the base 152, and motor fixing brackets 230 and 232. The motor fixing brackets 230 and 232 each have an insert part 234, through which the motor 190 is inserted, and first and second supporting legs 236 and 238 extending downwardly from the opposite sides of the insert part 234, respectively. The first and second supporting legs 236 and 238 are fitted on the supporting members 222 and 224.

The drum 160 has a space large enough to receive a large amount of clothes to be dried therein, and is provided at the inner circumference thereof with vanes 161 for lifting the clothes.

The condenser 166 has a first passageway 167, through which the circulating air passes, formed in the direction coaxial to the drum 60, and a second passageway 168, through which the outside air passes, formed in the direction perpendicular to the first passageway 167. When the air of high humidity used to dry the clothes in the drum 160 passes through the first passageway 167, the temperature of the air is reduced by heat exchange with the outside air passing through the second passageway 168, with the result that the humidity of the air passing through the first passageway 167 is lowered.

The first fan 170 is disposed in the first fan housing 171 surrounding the first fan 170.

The circulation duct comprises a first circulation duct (not shown) extended from the upper part of the drum 160 to the front part of the first passageway 167 of the condenser 166 for guiding the air of high humidity passing through the drum 160 to the first passageway 167 of the condenser 166, a second circulation duct 173*a* extended from the rear part of the first passageway 167 of the condenser 166 to the first fan housing 171 for guiding the air of low humidity passing through the first passageway 167 of the condenser 166 to the first fan housing 171, and a third circulation duct 173*b* for guiding the air leaving the first fan housing 171 to the rear of the drum 160.

The second fan 174 is disposed in the second fan housing 175 surrounding the second fan 174.

The suction duct comprises a first suction duct 177*a* connected to the second fan housing 175 for guiding the outside air into the second fan housing 175, a second suction duct 177*b* extended from one side of the second fan housing 175 to the inlet of the second passageway 168 of the condenser 166 for guiding the air blown by the second fan 174 to the second passageway 168 of the condenser 166, and a third suction duct (not shown) connected to the second passageway 168 of the condenser 166 for guiding the air passing through the second passageway 168 of the condenser 166 to the outside of the drying machine.

The motor 190 is provided at the front and rear ends thereof with front and rear shafts 190*a* and 190*b*, respectively. The second fan 174 is attached to the front end of the front shaft 190*a*, while the first fan 170 is attached to the rear end of the rear shaft 190*b*. A belt 200 is provided around the rear shaft 190*b* at the center thereof. The belt 200 is also provided around the drum 160.

Between the both ends of the motor 190 and the insert parts 234 of the motor fixing brackets 230 and 232 are provided vibration isolating rings 210 and 212 for absorbing vibration, respectively.

At the front and rear parts of the motor 190 are provided hubs 193 and 194 for supporting the motor 190, respectively. The vibration isolating rings 210 and 212 are fitted on the outer circumferences of the hubs 193 and 194. The motor fixing brackets 230 and 232 is placed in such a manner that the insert parts 234 are fitted on the outer circumferences of the vibration isolating rings 210 and 212.

Each of the supporting members 222 and 224 is formed in such a manner that the width between the opposite sides of each of the supporting members 222 and 224 is increased upwardly, while the motor fixing brackets 230 and 232 are formed in such a manner that the distance between the first and second supporting legs 236 and 238 is decreased downwardly.

The supporting members 222 and 224 and the motor fixing brackets 230 and 232 according to this embodiment are very similar to those of the previous embodiment, the structures of which will not be described.

The operation of the drying machine with the above-stated construction according to the present invention will now be described.

Clothes to be dried are put into the drum 160, and the door 154*b* is closed to operate the drying machine. The motor 190 is driven while being supported securely by the motor fixing brackets 230 and 232 and the supporting members 22 and 224.

When the motor 190 is driven, the belt 200 running around the rear shafts 190*b* rotates the drum 160. The second fan 174 attached to the front end of the front shaft 190*a* is rotated at the front of the motor 190 for sucking in outside air. The first fan 190*b* attached to the rear end of the rear shaft 190*b* is rotated at the rear of the motor 190 for circulating the air between the drum 160 and the condenser 166.

The clothes to be dried in the drum 160 are lifted by the vanes 161 and then dropped from the vanes 161. The air in the casing 154, which has been introduced from the outside, passes through the second passageway 168 of the condenser 166, and then flows out of the casing 154.

While the air in the drum 160 passes through the first passageway 167 of the condenser 166, moisture laden in the air is condensed to reduce the humidity of the air. The air of low humidity is heated at a high temperature by the heater 180. The heated air is introduced into the drum 160 to dry the clothes, and then circulated through the drum 160, the condenser 166, and the heater 180 to continue drying the clothes.

There occurs vibration from the motor 190, to which the first fan 170, the belt 200, and the second fan 174 are connected, while the clothes are being dried in the drying machine. However, such vibration is absorbed by means of the vibration isolating rings 210 and 212. The motor fixing brackets 230 and 232 are engaged securely with the supporting members 222 and 224 while the vibration isolating rings 210 and 212 are inserted into the insert parts 234 of the motor fixing brackets 230 and 232. Consequently, no vibration is transmitted to the base 152 or the casing 154.

As apparent from the above description, the present invention provides a drying machine including supporting members placed on a base, and motor fixing brackets each comprising an insert part, into which a motor is inserted, and first and second supporting legs extended downwardly from the opposite sides of the insert part and fitted on supporting members from the above, respectively, whereby any vibration of the motor is prevented and attachment/detachment of the motor is easy and convenient.

Each of the supporting members is formed in such a manner that the width between the opposite sides of each of the supporting members is increased upwardly, while the motor fixing brackets are formed in such a manner that the distance between the first and second supporting legs is decreased downwardly, so that the motor fixing brackets are fitted by force on the supporting members, whereby attachment/detachment of the motor fixing brackets is easy and any accidental detachment of the motor fixing brackets from the surrounding members is prevented.

The supporting members each have a fixing hole penetrating the supporting member from one side of the supporting member to the other side of the supporting member, and the motor fixing brackets are provided at the first and second supporting legs thereof with fixing holes each communicating with the fixing hole of the supporting member, respectively, so that the motor fixing brackets are attached fixedly to the supporting members by means of fixing screws, which are inserted into the fixing holes, at one side of at least one of the first and second supporting legs, whereby repair/replacement of the motor is easy and convenient.

The motor fixing brackets are configured in such a manner that the distance between the first and second supporting legs at the lower ends of the supporting legs is less than that between the first and second supporting legs at the upper ends of the supporting legs, and the motor fixing brackets are formed of plastic with a prescribed elasticity so that the motor fixing brackets are fitted on the supporting members along the sloping sides of the supporting members, whereby attachment of the motor fixing brackets is easy and convenient.

The motor fixing brackets each have a horizontal reinforcing bar formed between the opposite sides of the first and second supporting legs thereof, whereby any breakage of the first and second supporting legs is prevented.

The first and second supporting legs of each of the motor fixing brackets are provided at the lower ends thereof with bent parts, respectively, whereby the motor fixing brackets do not shake, the motor fixing brackets can stably support the motor, and the vibration from the motor is not transmitted to the base or the casing.

The fixing holes of the first and second supporting legs of the motor fixing brackets each have a thread part formed therein only at one side thereof, and the fixing screw has a thread part formed on the outer circumference thereof. Consequently, the first and second supporting legs approach each other by virtue of the engagement of the fixing screw into one of the fixing holes so that the first and second supporting legs come into secure contact with the inclined sides of the supporting members.

Moreover, the vibration isolating rings are disposed between the hubs provided at the front and rear parts of the motor and the insert parts of the motor fixing brackets, respectively, whereby the vibration from the motor is absorbed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A drying machine comprising:

a base;

a casing disposed on the base;

a drum rotatably placed inside the casing;

a heater for heating air;

a fan for blowing the air heated by the heater into the drum and for blowing the air passing through the drum outside the machine;

a motor for rotating the fan and the drum;

supporting members mounted on the base; and motor fixing brackets each including an insert part, and first and second supporting legs extending downwardly from the opposite ends of the insert part, the motor being inserted through the insert part, the first and second supporting legs being engageable with the supporting members.

2. The machine as set forth in claim 1, wherein each of the supporting members is formed in such a manner that the width between the opposite sides of the supporting member is increased upwardly, and wherein the motor fixing brackets are formed in such a manner that the distance between the first and second supporting legs is decreased downwardly.

3. The machine as set forth in claim 1, wherein the supporting members each have a fixing hole penetrating the supporting member from one side of the supporting member to the other side of the supporting member, and wherein the motor fixing brackets are provided at the first and second supporting legs thereof with fixing holes communicating with the corresponding fixing holes of the supporting members, respectively, so that the motor fixing brackets are attached fixedly to the supporting members by means of fixing screws inserted into the fixing holes, at one side of at least one of the first and second supporting legs.

4. The machine as set forth in claim 3, wherein the fixing holes of the first and second supporting legs of the motor fixing brackets each have a thread part formed therein only at one side thereof, and wherein the fixing screws each have a thread part formed on the outer circumference thereof.

5. The machine as set forth in claim 1, wherein the distance between the first and second supporting legs at the lower ends thereof is less than that between the first and second supporting legs at the upper ends thereof.

6. The machine as set forth in claim 1, wherein the motor fixing brackets are made of plastic.

7. The machine as set forth in claim 1, wherein a horizontal reinforcing bar is provided between the first and second supporting legs of the motor fixing brackets.

8. The machine as set forth in claim 1, wherein the first and second supporting legs of each of the motor fixing brackets are provided at the lower ends thereof with bent parts, respectively, whereby the motor fixing brackets are placed stably over a wider area of the base.

9. The machine as set forth in claim 1, wherein the motor has front and rear hubs, on the circumferences of which vibration isolating rings are fitted, respectively, wherein the supporting members include a front supporting member and a rear supporting member arranged apart from each other by the distance between the front and rear hubs, and wherein the motor fixing brackets include a front motor fixing bracket engaged with the vibration isolating ring on the front hub and the front supporting member, and a rear motor fixing bracket engaged with the vibration isolating ring on the rear hub and the rear supporting member.

10. A drying machine comprising:

a base;

a casing disposed on the base;

a drum rotatably placed inside the casing;

a condenser for condensing moisture laden in the air having passed through the drum by heat exchange between the air having passed through the drum and outside air;

a fan for blowing the air having passed through the condenser into the drum;

a heater for heating the air having passed through the condenser;

a motor for rotating the fan and the drum;

supporting members mounted on the base; and motor fixing brackets each including an insert part, and first and second supporting legs extending downwardly from the opposite ends of the insert part, the motor being inserted through the insert part, the first and second supporting legs being engageable with the supporting members.

11. The machine as set forth in claim 10, wherein each of the supporting members is formed in such a manner that the width between the opposite sides of the supporting member is increased upwardly, and wherein the motor fixing brackets are formed in such a manner that the distance between the first and second supporting legs is decreased downwardly.

12. The machine as set forth in claim 10, wherein the supporting members each have a fixing hole penetrating the supporting member from one side of the supporting member to the other side of the supporting member, and wherein the motor fixing brackets are provided at the first and second supporting legs thereof with fixing holes communicating with the corresponding fixing holes of the supporting members, respectively, so that the motor fixing brackets are attached fixedly to the supporting members by means of fixing screws inserted into the fixing holes, at one side of at least one of the first and second supporting legs.

13. The machine as set forth in claim 12, wherein the fixing holes of the first and second supporting legs of the motor fixing brackets each have a thread part formed therein only at one side thereof, and wherein the fixing screws each have a thread part formed on the outer circumference thereof.

14. The machine as set forth in claim 10, wherein the distance between the first and second supporting legs at the lower ends thereof is less than that between the first and second supporting legs at the upper ends thereof.

15. The machine as set forth in claim 10, wherein the motor fixing brackets are made of plastic.

16. The machine as set forth in claim 10, wherein a horizontal reinforcing bar is provided between the first and second supporting legs of the motor fixing brackets.

17. The machine as set forth in claim 10, wherein the first and second supporting legs of each of the motor fixing brackets are provided at the lower ends thereof with bent parts, respectively, whereby the motor fixing brackets are placed stably over a wider area of the base.

18. The machine as set forth in claim 10, wherein the motor has front and rear hubs, on the circumferences of which vibration isolating rings are fitted, respectively, wherein the supporting members include a front supporting member and a rear supporting member arranged apart from each other by the distance between the front and rear hubs, and wherein the motor fixing brackets include a front motor fixing bracket engaged with the vibration isolating ring on the front hub and the front supporting member, and a rear motor fixing bracket engaged with the vibration isolating ring on the rear hub and the rear supporting member.

19. The machine as set forth in claim 10, further comprising a second fan attached to a rotating shaft of the motor for blowing outside air to the condenser.

* * * * *